US005197913A

United States Patent [19]

Suzuki

[11] Patent Number: 5,197,913

[45] Date of Patent: Mar. 30, 1993

[54] METHOD AND APPARATUS FOR CONTROLLING PITCH ATTITUDE OF A TOY IN A FLUID

[75] Inventor: Toshio Suzuki, Tokyo, Japan

[73] Assignee: Toybox Corporation, Tokyo, Japan

[21] Appl. No.: 683,884

[22] Filed: Apr. 11, 1991

[30] Foreign Application Priority Data

Apr. 11, 1990 [JP] Japan ..... 2-38934[U]

[51] Int. Cl.[5] ..... A63H 23/00; A63B 71/00

[52] U.S. Cl. ..... 446/156; 446/158; 273/140

[58] Field of Search ..... 446/156, 155, 154, 153, 446/157, 158, 159, 160, 161, 162, 163, 164, 207; 273/140

[56] References Cited

U.S. PATENT DOCUMENTS

| | | | |
|---|---|---|---|
| 2,611,996 | 9/1952 | Garelick | 446/158 |
| 2,854,787 | 10/1958 | Oberg | 446/158 |
| 2,920,419 | 1/1960 | Giannone | 446/154 |
| 2,990,645 | 7/1961 | Polzin | 273/140 |
| 3,412,482 | 11/1968 | Kusmer | 446/155 X |
| 3,434,234 | 3/1969 | Watts et al. | 446/158 |
| 3,808,734 | 5/1974 | Suzuki | 446/158 |
| 3,924,350 | 12/1975 | Hsu | 446/154 |
| 4,068,401 | 1/1978 | Saitoh | 446/158 |
| 4,713,037 | 12/1987 | Tong | 446/156 X |

FOREIGN PATENT DOCUMENTS

| | | | |
|---|---|---|---|
| 910066 | 11/1962 | United Kingdom | 446/158 |
| 1189085 | 4/1970 | United Kingdom . | |
| 1382757 | 2/1975 | United Kingdom . | |
| 1432598 | 4/1976 | United Kingdom | 446/158 |
| 2080129 | 2/1982 | United Kingdom | 446/158 |
| 2212409 | 7/1989 | United Kingdom | 446/158 |
| 2243088 | 10/1991 | United Kingdom | 446/158 |

*Primary Examiner*—D. Neal Muir
*Attorney, Agent, or Firm*—Staas & Halsey

[57] ABSTRACT

An apparatus for controlling pitch or yaw attitudes of a toy in a fluid includes a body and a float movably mounted to the body. The position of the float relative to the body can be changed to modify the pitch or yaw attitudes of the body in the fluid. The body can also be equipped with a member to propel the body in the fluid, and a fluid projector which propels fluid from the body. A driver can be connected to the float, the member, and the fluid projector so that the body alternately swims and treads water, and projects fluid while treading water.

16 Claims, 5 Drawing Sheets

METHOD AND APPARATUS FOR CONTROLLING PITCH ATTITUDE OF A TOY IN A FLUID

BACKGROUND OF THE INVENTION

1. Field of the Invention

The present invention generally relates to a method and apparatus for changing the pitch attitudes of a toy in a fluid, or more particularly, to a method and apparatus which allows a toy in water to alternately swim and tread water. In a preferred embodiment, the toy includes a fluid projector which projects fluid from the toy and a member which propels the toy in the fluid.

2. Description of the Related Art

A known mechanism for rotating a swimming toy is disclosed in Japanese Utility Model Publication No. 27518/1982. It includes a rotary shaft extending in the direction in which the toy can be propelled, and a float and a weight which are carried on the shaft on the opposite side thereof from each other. The rotary shaft is rotatable to rotate the main body of the toy about its axis.

The invention of Japanese Utility Model Publication No. 27518/1982 as hereinabove explained is suitable for a toy model of a fish which maintains a horizontal posture when it is propelled, but has been unable to give the toy any such motion of treading water as, for example, that of a dolphin or orca because of the lack of an apparatus or method for changing the pitch attitude of the toy in the water.

SUMMARY OF THE INVENTION

Accordingly, an object of the present invention is to provide a method and apparatus for changing a pitch attitude of a toy in a fluid.

Another object of the present invention is to provide a method and apparatus for changing the pitch attitude of a toy in a fluid while propelling the toy in the fluid.

another object of the present invention is to provide a method and apparatus for changing the pitch attitude of a toy in a fluid which toy is able to project fluid.

The above objects are obtained by the apparatus and method herein disclosed. According to the present invent there is provided an apparatus for changing the pitch attitude of a body in a fluid, comprising: a first float; and a driver coupled to said first float and the body, which changes the pitch attitude of the body in the fluid by changing a positional relationship between said first float and the body.

According to the present invention, there is also provided a toy operable in a fluid, comprising: a body; a float movably mounted to said body; means for propelling said body in the fluid; and means for changing the pitch attitude of said body in the fluid by changing a positional relationship between said float and said body.

Also according to the present invention, there is further provided a toy operable in a fluid, comprising: a body; and a float movably mounted to said body, which is movable to change the pitch attitude of said body in the fluid by changing a positional relationship between said float and said body.

These together with other objects and advantages, which will become subsequently apparent, residing in the details of construction and operation as more fully hereinafter described and claimed, reference being add to the accompanying drawings, forming a part hereof, wherein like numerals refer to like parts throughout.

DESCRIPTION OF THE PREFERRED EMBODIMENTS

Figure 1:
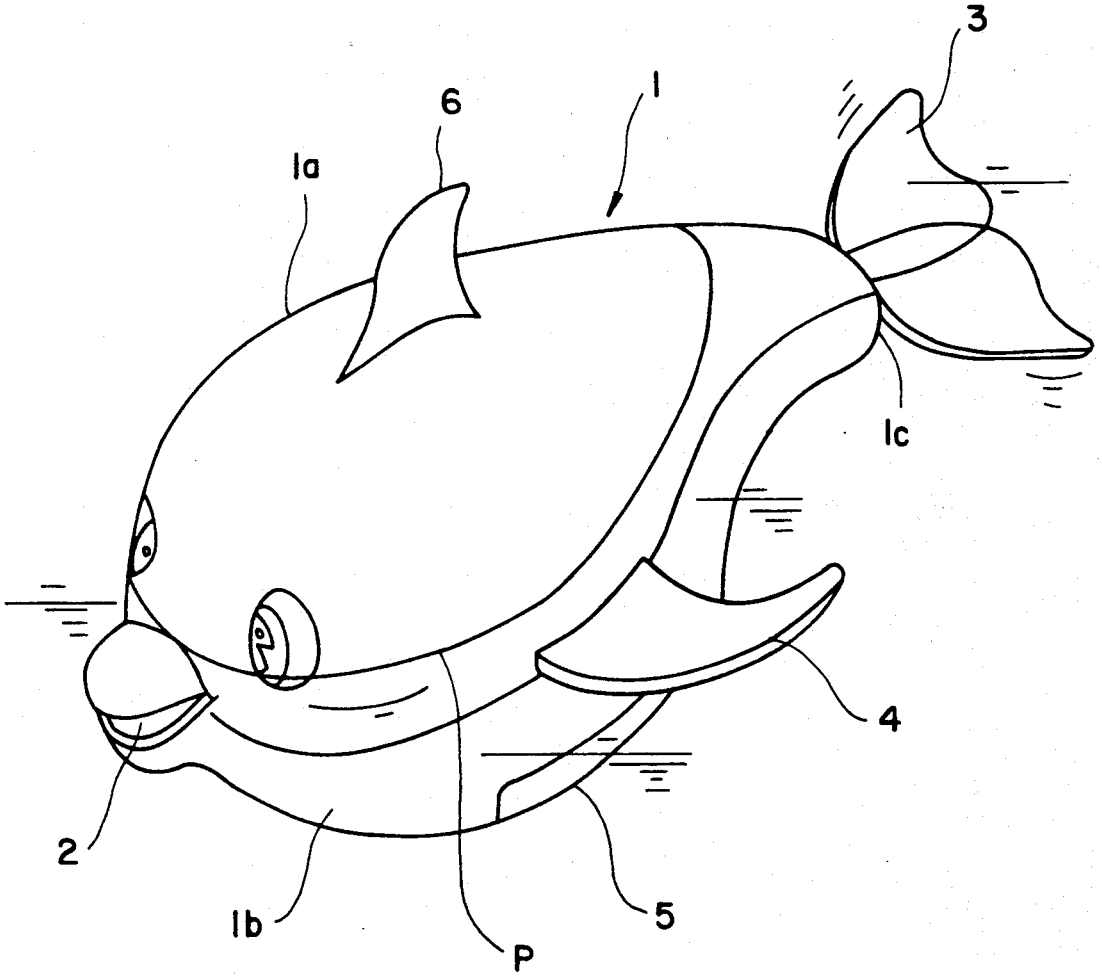
FIG. 1 is a perspective view of the body of a toy in accordance with the present invention.

In FIG. 1, the body 1 is shaped like a dolphin, and comprises an upper half 1*a* and a lower half 1*b* joined together by screws or other appropriate joining means. The body 1 has a mouth 2 at its front end, and a member 3 at the rear end, which member 3 can be used to propel the body 1 in a fluid by pivotal motion of the member 3. A pair of pectoral fins 4 project from both sides of the body 1, and a dorsal fin 6 extends vertically from a top surface of the body 1. The lower half 1*b* is provided with a cover 5 which swings open to allow an operator to insert or extract the batteries 46. The mouth 2 and an opening 1*c* at which the member 3 is connected to the body 1 are designed to allow fluid to freely enter or exit the body 1. This feature allows the body 1 to sink into the fluid to the water line P so that the member 3 is substantially under the surface of the fluid so that member 3 is able to propel the body 1 in the fluid.

Figure 2:
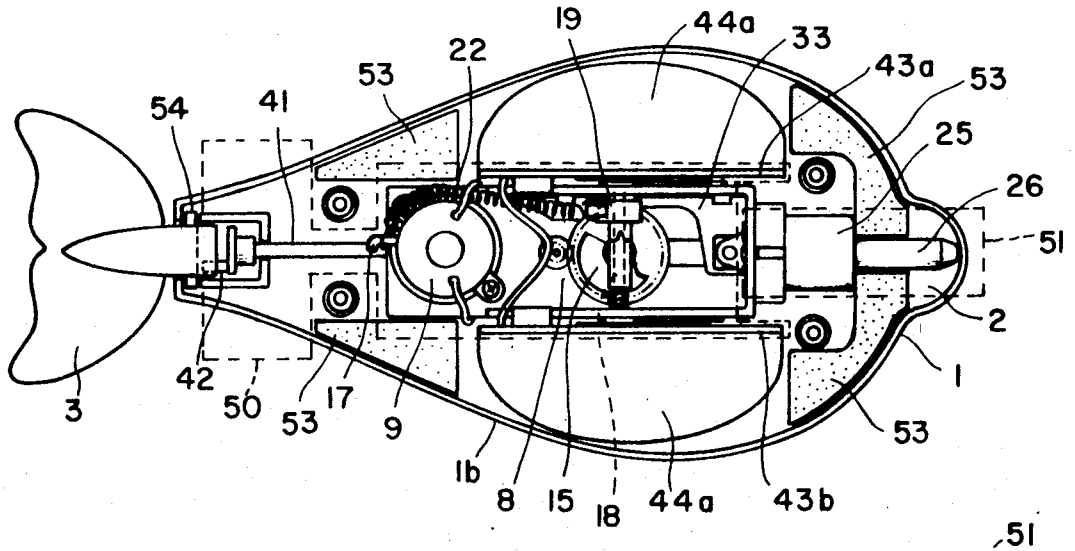
FIG. 2 is a top plan view of a driver and other mechanisms associated with the driver which are mounted in the body.

FIG. 2 is a top plan view of the body 1 illustrating the member 3, the driver 50, a first float 44*a*, a second float 44*b* and a fluid projector 51 which together comprise a means for changing the pitch attitude of the body 1 in the fluid by changing a positional relationship between the first float 44*a* and the second float 44*b*, and the body 1. The apparatus for controlling the pitch attitude of the toy in a fluid is essentially comprised of the driver 50, the first float 44*a* and the second float 44*b*. The first float 44*a* and the second float 44*b* are each attached to respective float holders 43*a* and 43*b*. The float holders 43*a* and 43*b* are attached to the opposite ends of a shaft 18 which is rotatably supported on a frame 8 through which the shaft 18 passes. A change in the positional relationship between the first float 44*a* and the second float 44*b* relative to the body 1 is accomplished by rotating first float 44*a* and the second float 44*b* about an axis defined by the shaft 18. Such change in the positional relationship between the first float 44*a* and the second float 44*b* relative to the body 1 allows the pitch attitude of the body 1 in the fluid to be changed. This change in the positional relationship between a float or a float system and a body is the essence of one aspect of the present invention.

In the embodiment of FIG. 2, the driver 50 is used to change the positional relationship between the first float 44*a* and the second float 44*b* relative to the body 1. An explanation of the driver 50 will now be provided with reference to FIGS. 2 and 3.

Figure 3:
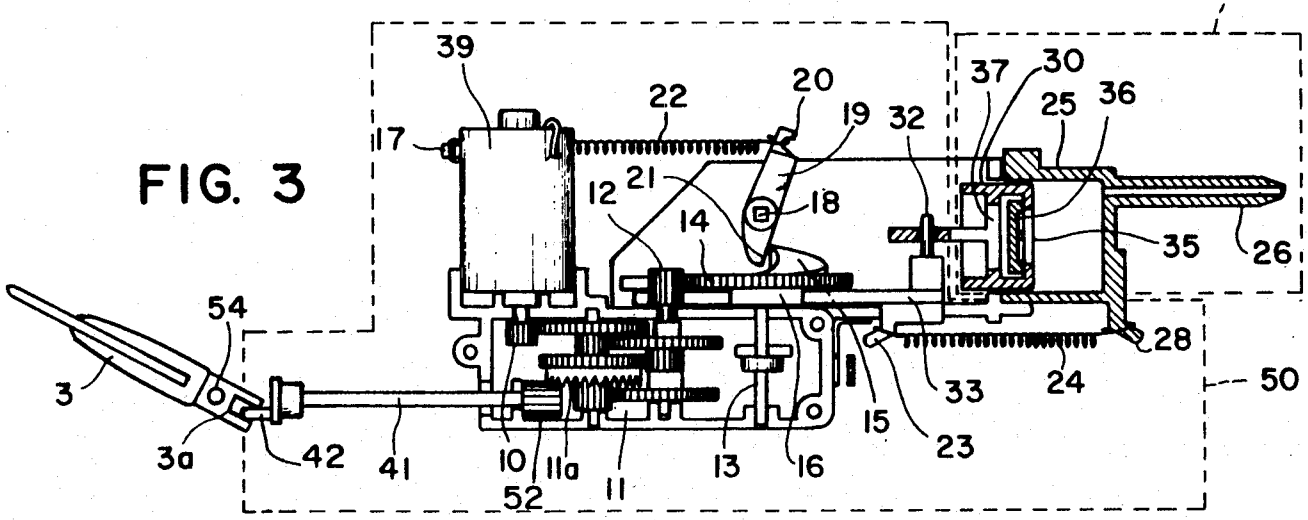
FIG. 3 is a fragmentary sectional view showing the construction of a driver, member and fluid projector in accordance with the present invention.

The frame 8 is shaped like a rectangular box, as shown in FIG. 2, and carries an upstanding waterproof casing 9 which houses a motor 39 As viewed in FIG. 3, a motor pinion 10 extends downward from the upstanding waterproof casing 9 and connects with a gear train 11. The pinion 12 extends upward from the gear train 11 and connects with a gear 14 which has a first cam 15 on the top side thereof. First cam, 15 contacts a first end of a rotating level 19 which is connected to the shaft 18 so that a torque can be provided about the access defined by the shaft 18. The second end of the rotating lever 19 has a pin 20 for retaining a first end of a return spring 22. The second end of the return spring 22 is attached to a lug 17 protruding from the upstanding waterproof casing 9 on the rearward side. The return spring 22 thus urges the first end of the rotating lever 19 against the first cam 15.

Figure 8A:
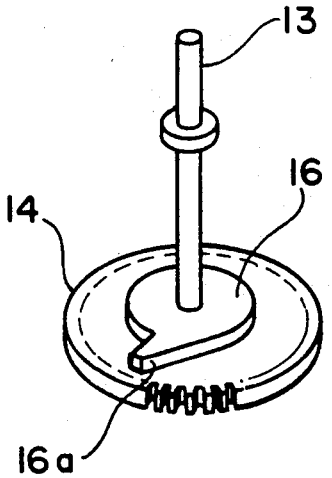
FIGS. 8(*a*)–8(*b*) are enlarged perspective views showing the first and second cams which are used to drive the fluid projector and first and second floats in accordance with a preferred embodiment of the present invention.
Figure 8B:
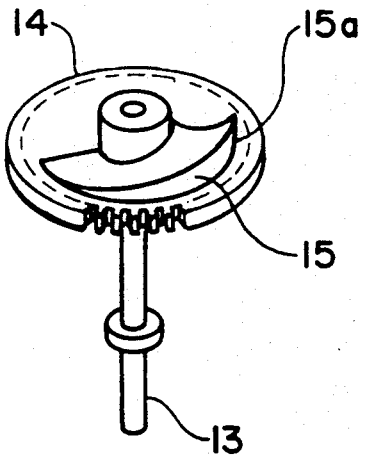

As shown in FIG. 8(*b*), the gear 14 is coupled to a gear shaft 13 at the center of the gear 14. The first cam 15 includes a projection 15*a*. As the motor 39 drives the gear 14 through the gear train 11, the projection 15*a* of the first cam 15 is caused to make contact with the first end of the rotating lever 19. This causes a torque to be applied by the rotating level 19 which in turn changes the positional relationship of the first float 44*a* and the second float 44*b* by rotation relative to the body 1. The pitch attitude of the body 1 in the fluid is thereby changed.

As the leading edge of the projection 15*a* moves passed the end of the rotating level 19 by the rotation of the gear 14, the first end of the rotating level 19 gradually returns to a position in which the first end of the rotating level 19 contacts the top surface of the gear 14. Thereby, the first float 44*a* and the second float 44*b* are given a periodic motion about the access defined by the shaft 18 when the toy is operated.

The embodiment of FIGS. 2 and 3 also includes a second aspect of the present invention which is an apparatus for propelling the body 1 in a fluid. This second aspect of the present invention is accomplished by the member 3 working in conjunction with the driver 50 which together comprise a means for propelling the body 1 in the fluid. As explained above, the driver 50 includes a motor 39 housed in an upstanding waterproof casing 9 which is connected to the frame 8 through which a motor pinion 10 extends in a downward direction as viewed in FIG. 3. The driver 50 further includes a rotary shaft 41 having a pinion 52, and an eccentric pin 42 connected at opposite ends of the rotary shaft 41. The pinion 52 connects with a crown gear 11A included within the gear train 11. Under the driving force of the motor 39, the eccentric pin 42 is rotated by the rotary shaft 41, the pinion 52, the gear train 11 and the pinion 10. The eccentric pin 42 is fitted in a groove 3*a* at the base end of the member 3. The rotation of the eccentric pin 42 under the driving force of the motor 39 causes the member 3 to move pivotally around a pivot pin 54. Under the pivotal motion of the member 3, the body 1 can be propelled in a fluid.

Figure 7:
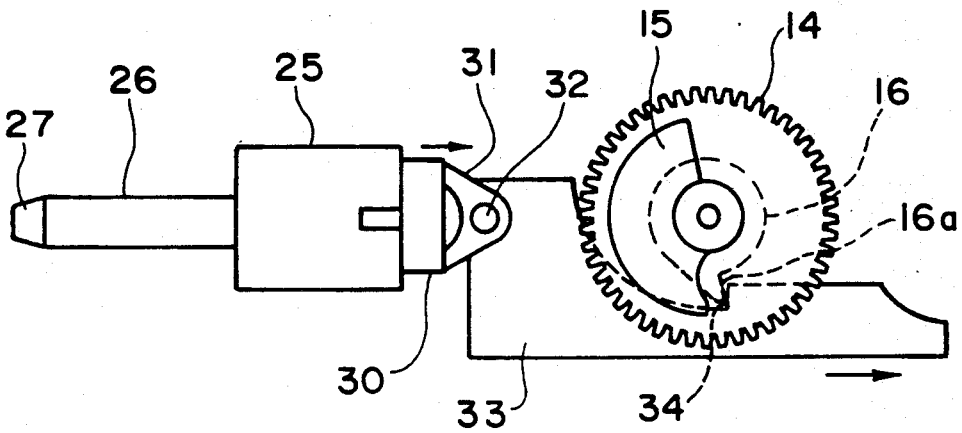
FIG. 7 is an enlarged top plan view of the fluid projector in accordance with a preferred embodiment of the present invention.

The embodiment of FIGS. 2 and 3 also includes a third aspect of the present invention. In the embodiment of FIGS. 2 and 3, the third aspect of the present invention is accomplished by the water projector 51 working in conjunction with the driver 50 which together comprise a means for projecting fluid from the body 1. In addition to the elements stated above, the driver 50 of FIGS. 2 and 3 further includes a sliding plate 33 having an engaging shoulder 34 (not shown in FIGS. 2 and 3), a pin 32 and a lug 23, a tension spring 24/, and a lug 28. The sliding plate 33 is slidably supported in the frame 8. The sliding plate 33 is normally urged toward the right as viewed in FIG. 3 by tension spring 24 stretched between lug 23 and lug 28. As shown in FIG. 8(A), the gear 14 has a second cam 16 connected to the bottom side of the gear 14. The second cam 16 has a projection 16*a* which contacts the engaging shoulder 34 of the sliding plate 33 as shown in FIG. 7 upon rotation of the gear 14. As the gear 14 further rotates under the driving force of the motor 39, the projection 16*a* forces the sliding plate 33 to move to the left as viewed in FIG. 3. Upon still further rotation of the gear 14, the projection 16*a* slips from the engaging shoulder 34 and the tension spring 24 forces the sliding plate 33 to move abruptly to the right as viewed in FIG. 3. The above movement of the sliding plate 33 causes a driving force to be supplied to the fluid projector 51 periodically through a pin 32 as the toy is operated.

As shown in FIG. 3, the fluid projector 51 essentially includes a piston 30, a cylinder 25 and a nozzle 26. Fluid is projected from the fluid projector 51 by compressing fluid within the cylinder 25 by moving the piston 30 to the right as viewed in FIG. 3. The fluid within the cylinder 25 is thereby forced through the nozzle 26 and projected outward from the fluid projector 51.

To enable fluid to quickly enter the cylinder 25, the piston 30 has two holes 35 and 37 which, define a water passage, and a check valve 36 which is formed from an elastic material defined between the hole 37 and 35. As shown best in FIG. 7, a lug 31 extends outward from the piston 30 and connects with the pin 32 of the sliding plate 33 to provide the connection between the water projector 51 and the driver 50.

Figure 4:
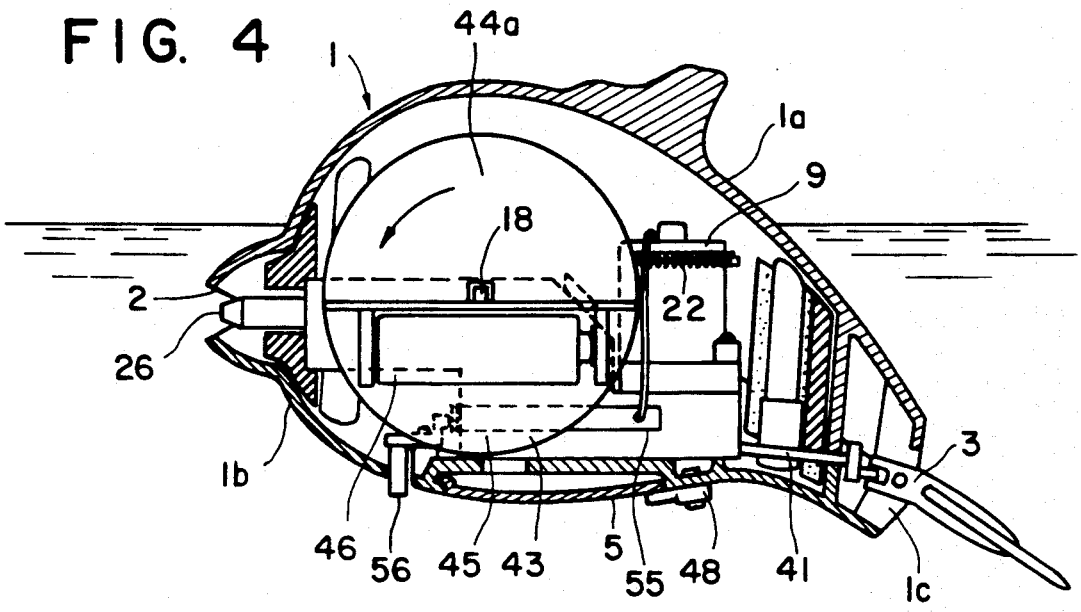
FIGS. 4 and 5 are cross-sectional views of a toy in accordance with the present invention, for explaining the method and apparatus for changing the pitch attitude of the toy, and for explaining the operation of the fluid projector.
Figure 5:
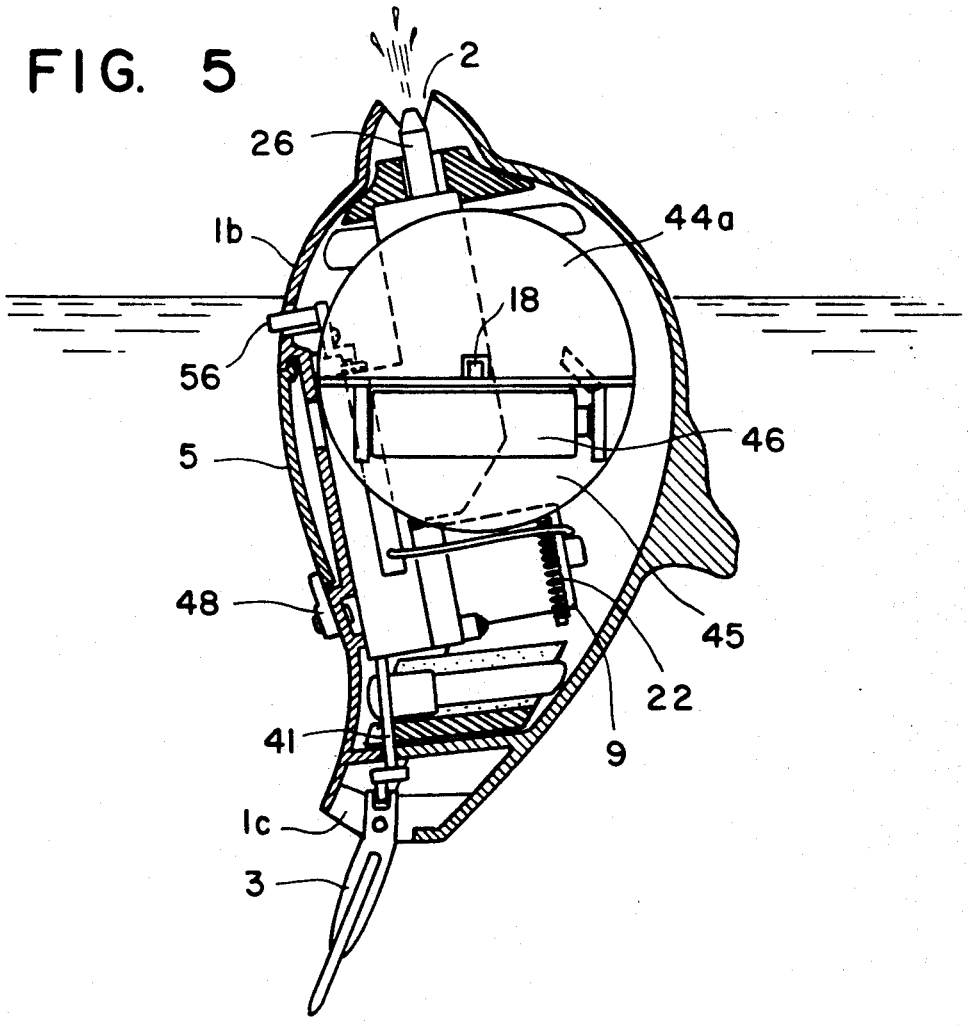

In FIGS. 4 and 5, the float holders 43*a* and 43*b* can be used to house respect batteries 46 on the lower part thereof. As viewed in FIG. 6, the batteries 46 are connected to a series of wires 47 and contacts 55. When a switch 56 is closed, the contacts 55 connect so the power is provided from the batteries 46 to the motor 39.

Figure 6:
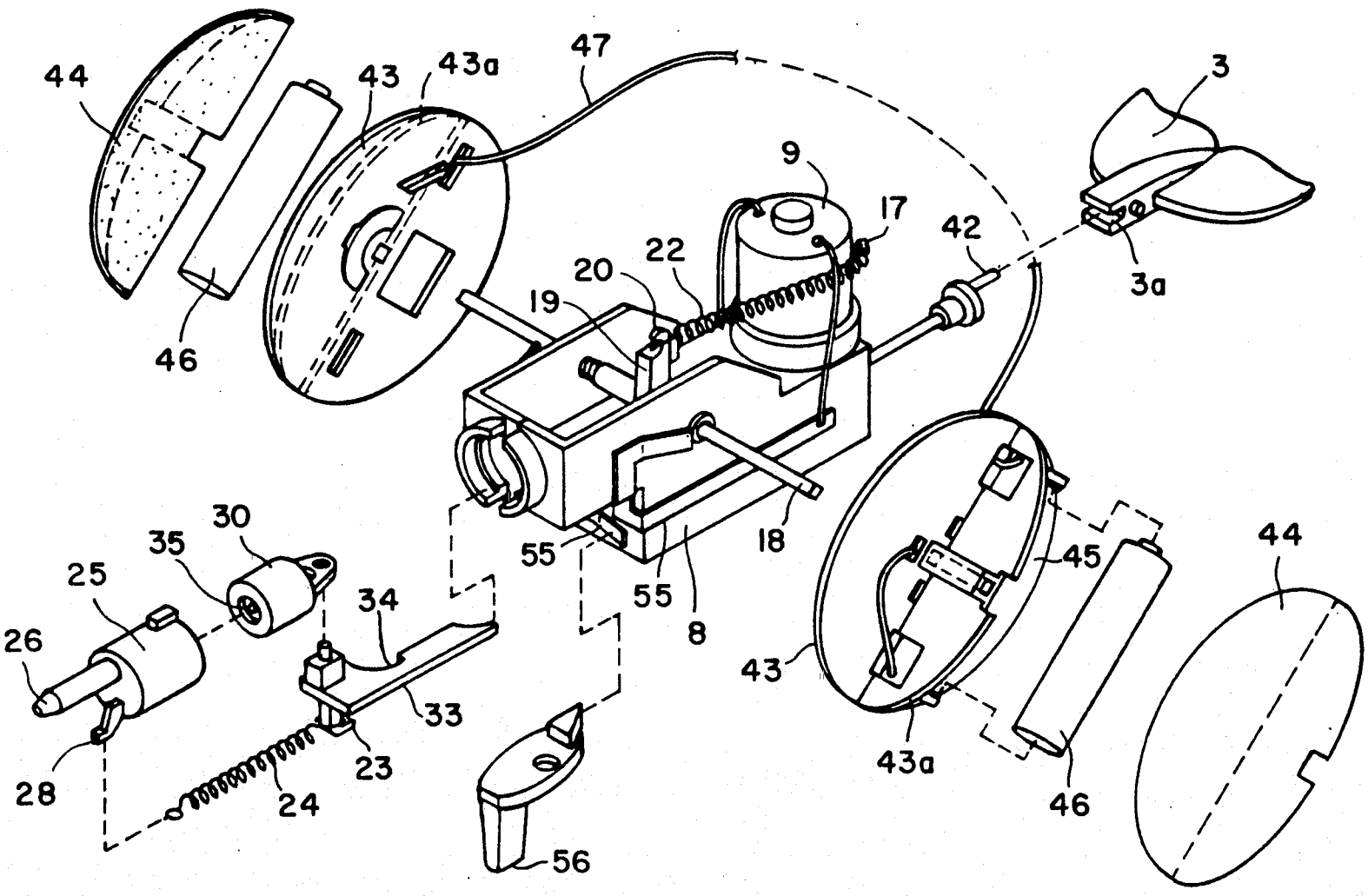
FIG. 6 is an exploded perspective view of an apparatus for changing the pitch attitude of a toy in a fluid, a member for propelling the toy in the fluid, a fluid projector, and a driver in accordance with a preferred embodiment of the present invention.

In addition to providing power to the motor 39, the batteries 46 also serve as weights in the preferred embodiment of FIGS. 4–6. The addition of the weight provided by the respective batteries 46 allows the first float 44*a* and the second float 44*b* to more readily maintain their position relative to the surface of the fluid when the pitch attitude of the body 1 is changed by changing the positional relationship between the first float 44*a* and the second float 44*b* relative to the body 1. Therefore, the position of the float 44*a* and the battery 46 relative to the surface of the fluid is substantially the same when the body 1 is in a swimming position as shown in FIG. 4 compared to a treading water position as shown in FIG. 5.

In order to enable an operator to insert or extract the batteries 46, a latch 48 can be pivoted to allow the hatch 5 to be opened so that the operator can access that part of the float holders 43*a* and 43*b* which holds the batteries 46.

The overall operation of the embodiment of the present invention shown in FIGS. 4 and 5 is as follows. In FIG. 4, the positional relationship between the first float 44*a* and the second float 44*b* relative to the body 1 causes the body 1 to be in the swimming position. The pivotal motion of the member 3 under the driving influence provided by the motor 39 propels the body 1 to the left as viewed in FIG. 4. As the leading edge of the projection 15*a* of the first cam 15 makes contact with the rotating lever 19, the pitch attitude of the body 1 changes to a treading water position as the positional relationship of the first float 44*a* and the second float 44*b* relative to the body 1 is changed. While the body 1 is in the treading water position, the projection 16*a* of the second cam 16 slips from the engaging shoulder 34 so that the sliding plate 33 abruptly moves to the left as shown in FIG. 7, thereby causing the piston 30 to move forward and the cylinder 25 to project fluid from the nozzle 26. As the gear 14 further rotates under the driving force provided by the motor 39, the positional relationship between the first float 44*a* and the second float 44*b* relative to the body 1 is changed so that the body 1 gradually assumes the swimming position of FIG. 4. The above series of motions is repeated for every full turn of the gear 14. To steady the motion of the body 1, balancers 53 which are composed a floating material can be provided within the body 1.

The present invention may be implemented in numerous ways. For example, although the separation between the first float 44*a* and the second float 44*b* provides stability for the body the first float 44*a* and the second float 44*b* can be combined into one float. Further, each of the aspects of the present invention can be separately implemented. Therefore, the driver 50 need not necessarily provide the driving force to the member 3, the first float 44*a* and the second float 44*b*, and the fluid projector 51 simultaneously, and the driver 50 could supply the driving force to any individual or pair combination of the member 3, the first float 44*a* and the second float 44*b*, and the fluid projector 51. Further, the driver need not be limited to the specific driver of FIGS. 1–8(*b*) and could be implemented through a variety of suitable apparatuses such as an elastic band or wind-up motor. Further, the member 3 need not be pivotally mounted to the body 1 by a pivot pin 54, but could be movably mounted in a variety of ways (such as rotably mounted) to propel the body 1 in the fluid.

The many features and advantages of the present invention are apparent from the detailed specification and thus, it is intended by the appended claims to cover all such features and advantages of the devices and methods which follow in the true spirit and scope of the invention. Further, since numerous modifications and changes will readily occur to those skilled in the art, it is not desired to limit the invention to the exact construction and operation illustrated and described. Accordingly, all suitable modifications and equivalence maybe resorted to as falling within the scope and spirit of the invention.

We claim:

1. An apparatus for changing a pitch attitude of a body in a fluid, comprising:

a first float housed within the body; and a motorized driver coupled to said first float and the body, which changes the pitch attitude of the body in the fluid by changing a positional relationship between said first float and the body.

2. An apparatus as claimed in claim 1, further comprising:

a second float coupled to said first float.

3. An apparatus as claimed in claim 2, further comprising:

a first weight coupled to the first float; and a second weight coupled to the second float.

4. A toy apparatus operable in water, comprising:

a body;

a float movably mounted within said body;

means for propelling said body in the fluid; and motorized means for changing a pitch attitude of said body in the fluid by changing a positional relationship between said float and said body.

5. A toy apparatus operable in water as claimed in claim 4, further comprising:

means for projecting water from said body.

6. A toy apparatus operable in water, comprising:

a body;

a float movably mounted within said body, which is movable to change a pitch attitude of said body in the water by changing a positional relationship between said float and said body; and a motorized driver coupled to said float, which drives said float.

7. A toy apparatus operable in water as claimed in claim 6, further comprising:

a member movably mounted to said body, which propels said body in the fluid.

8. A toy apparatus operable in water as claimed in claim 6, further comprising:

a member movably mounted to said body, which propels said body in the water, said member being coupled to said driver which drives said member.

9. A toy apparatus operable in water as claimed in claim 6, further comprising:

a fluid projector mounted to said body, which projects fluid from said body.

10. A toy apparatus operable in water as claimed in claim 9, further comprising:

a driver coupled to said float and fluid projector, which drives said float and fluid projector.

11. A toy apparatus operable in water as claimed in claim 10, further comprising:

a member movably mounted to said body, which propels said body in the fluid, wherein said member is coupled to said driver which drives said member.

12. A toy apparatus operable in water as claimed in claim 11, further comprising:

a weight coupled to said float.

13. A method for operating a toy apparatus in a fluid, said apparatus including a float coupled to a body, comprising the step of:

a) changing a pitch attitude of the body in the fluid by changing a positional relationship between the float housed within the body, and the body, by using a motorized driver.

14. A method for operating a toy apparatus in a fluid as claime in claim 13, further comprising the step of:

b) propelling said body in the fluid.

15. A method for operating a toy apparatus in water as claimed in claim 13, further comprising the step of:

c) projecting fluid from said body.

16. A method for operating a toy apparatus in water as claimed in claim 14, further comprising the step of:

b) projecting fluid from said body.

* * * * *

UNITED STATES PATENT AND TRADEMARK OFFICE

CERTIFICATE OF CORRECTION

PATENT NO. :5,197,913
DATED :March 30, 1993
INVENTOR(S) :Toshio Suzuki

It is certified that error appears in the above-indentified patent and that said Letters Patent is hereby corrected as shown below:

Column 1, line 8, change "attitudes" to --attitude--.

Signed and Sealed this

Twenty-sixth Day of April, 1994

*Attest:*

*Attesting Officer*

BRUCE LEHMAN

*Commissioner of Patents and Trademarks*